United States Patent [19]

Grabel

[11] Patent Number: 4,943,061

[45] Date of Patent: Jul. 24, 1990

[54] MULTI-POSITION DROP TARGET

[75] Inventor: Irwin J. Grabel, Elmwood Park, Ill.

[73] Assignee: Williams Electronics Games, Inc., Chicago, Ill.

[21] Appl. No.: 396,998

[22] Filed: Aug. 22, 1989

[51] Int. Cl.[5] ..... A63B 71/00

[52] U.S. Cl. ..... 273/127 R

[58] Field of Search ..... 273/118 D, 127 R, 121 A, 273/181 D, 121 R, 127 C, 129 S, 123 A, 119 A, 181 E, 1 ES; 200/61.11; D21/1

[56] References Cited

U.S. PATENT DOCUMENTS

| | | | |
|---|---|---|---|
| 4,221,384 | 9/1980 | Krynski | 273/118 D |
| 4,249,736 | 2/1981 | Rosenthal | 273/127 R |
| 4,257,604 | 3/1981 | Grable | 273/127 R |
| 4,260,156 | 4/1981 | Momura | 273/127 R |
| 4,353,553 | 10/1982 | Krynski | 273/121 R |
| 4,354,681 | 10/1982 | Garbar | 273/127 R |
| 4,773,646 | 9/1988 | Joos et al. | 273/127 R |
| 4,804,186 | 2/1989 | Moravac | 273/127 R |

*Primary Examiner*—Theatrice Brown

*Attorney, Agent, or Firm*—Rockey and Rifkin

[57] ABSTRACT

A drop target for a pinball game has a target member movable between raised and lowered positions and general intermediate positions. A solenoid mechanism is employed to reset the display target to its raised position. Optional detectors permit tracking of the position of the target so that appropriate scoring procedures can be implemented.

7 Claims, 3 Drawing Sheets

MULTI-POSITION DROP TARGET

BACKGROUND OF THE INVENTION

This invention relates to the field of coin-operated amusement devices. More particularly, it relates to rolling ball games such as pinball games in which a sloped playfield is provided on which a ball rolls. Various features are disposed on the playfield and the player, by using flippers, seeks to activate the features by directing the pinball at them.

One popular playfield feature is commonly referred to as a drop target. Drop targets consist of an assembly mounted to the underside of the playfield and a target extending above the playfield through an opening therein. When a pinball strikes the target it drops flush with or below the playfield, thereby to provide an indication that the player has successfully hit the target and is entitled to whatever points or bonuses are provided for in the game rules, implemented by way of a micro-processor and control program. In due course, the drop target is reset, that is, restored to its position above the playfield. This is accomplished, in the usual case, by one or more solenoids which, when actuated, push the drop target to its raised position where a latching mechanism retains it until struck by the pinball.

In order to enhance player appeal, it is desired to improve on existing playfield drop targets to permit more intricate and complex game rules. More specifically, it is desireable to provide a playfield feature in the form of a drop target which has severa positions, thereby to require the player to strike it more than once to cause it to drop from the playfield. Such a device would permit game designers to add interest and challenge which is not presently available. Such a device would require means for detecting the present position of the drop target so that the micro-processor can monitor the players progress and award appropriate points and bonuses.

It is accordingly an object of the present invention to provide such an improved, multi-position drop target.

It is a further object of the invention to provide a multiposition drop target having means for detecting the current position of the drop target and for communicating that information to a control unit.

Another object of the invention is to provide a multi-position drop target having means for resetting the target t its initial raised position or intermediate positions whenever desired.

These and other objects and advantages of the invention will be apparent from the remaining portion of the specification.

DETAILED DESCRIPTION OF THE PREFERRED EMBODIMENT

Figure 1:
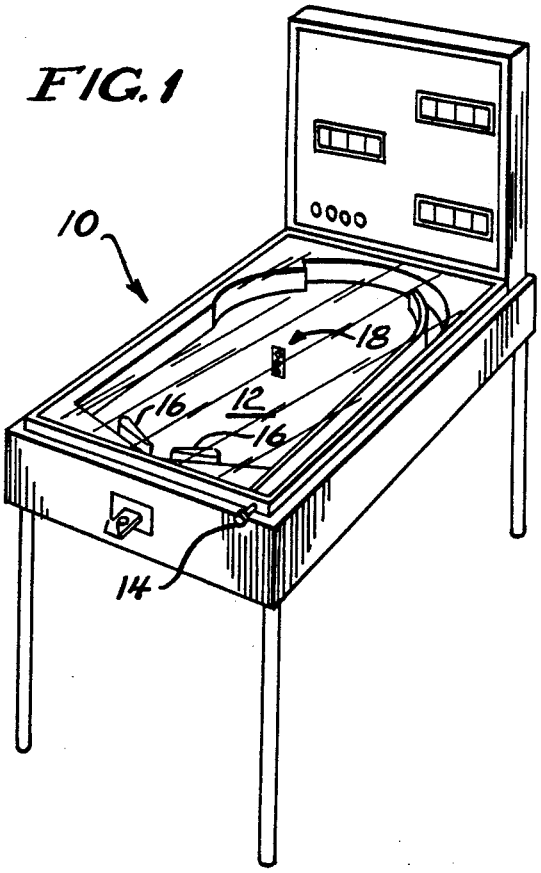
FIG. 1 is a perspective view, in simplified format, of a rolling ball game for which the present invention is suited.

Referring to FIG. 1, there is shown in simplified form a typical rolling ball game or pinball machine 10. The device includes a playfield 12, a plunger 14 for propelling the pinball onto the playfield and a pair of player controlled flippers 16, by which the player attempts to direct the pinball at various same features on the playfield. An actual pinball game has a wide variety of such playfield features, but for simplicity, FIG. 1 shows only a single playfield feature, the multi-position drop target 18 of the present invention.

Figure 2:
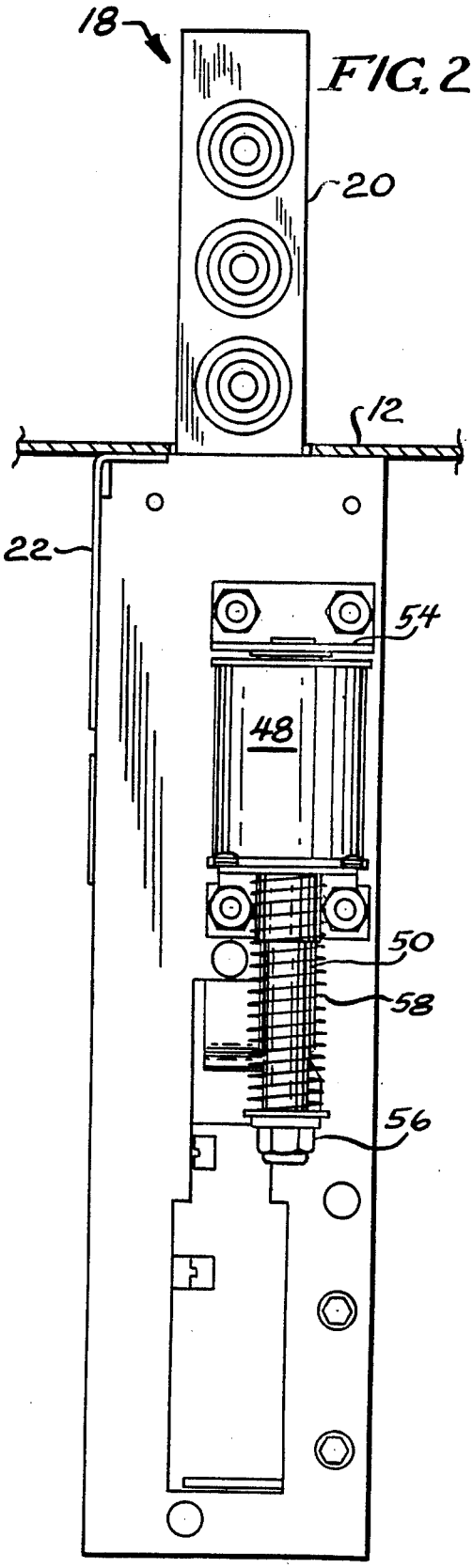
FIG. 2 is a front elevational view of the invention.
Figure 3:
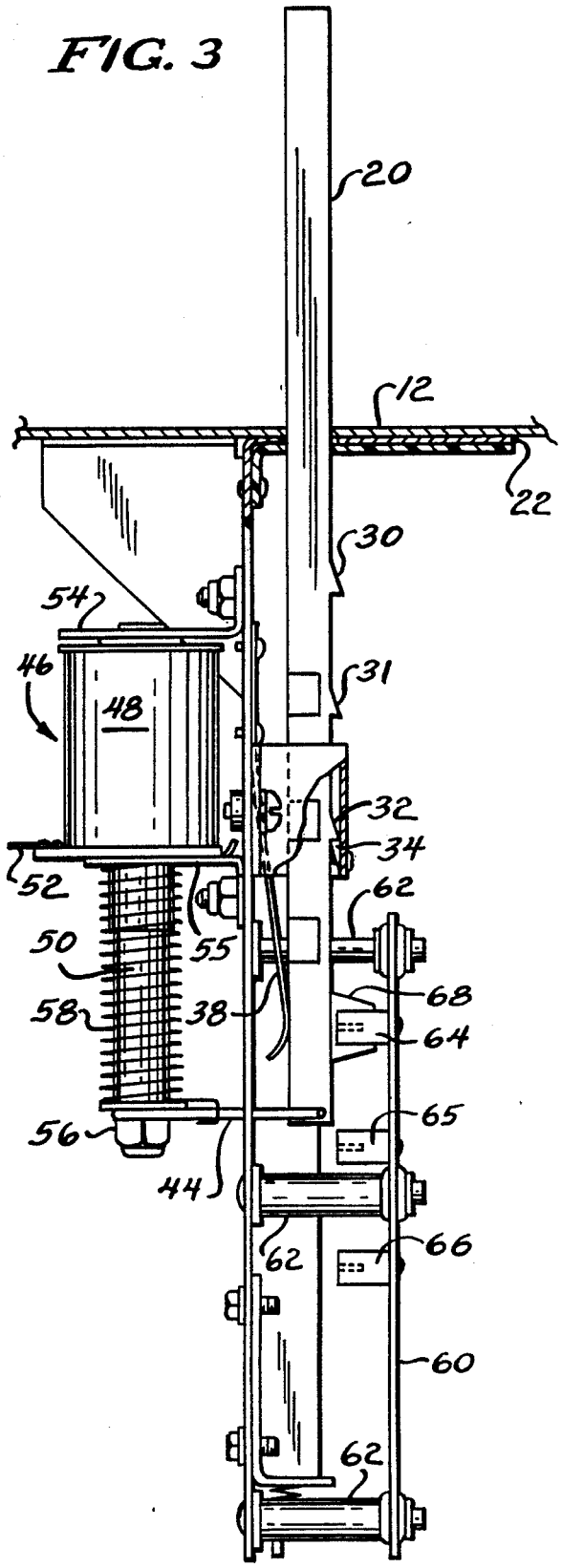
FIG. 3 is a side elevation of the invention.

Referring to FIGS. 2 and 3, the details of the invention are illustrated. The drop target consists of a target member 20 disposed substantially vertically extending both above and below an opening in the playfield 12. Painted on a portion of the target member 20, extending above the playfield, may be appropriate art work, such as a bulls eye. In the embodiment disclosed in the specification, the invention is described as a three-position drop target, that is, it must be struck by a pinball three times to cause it to disappear from the field of play. Obviously greater or fewer positions can be provided as desired following the teachings of the present invention.

Figure 4:
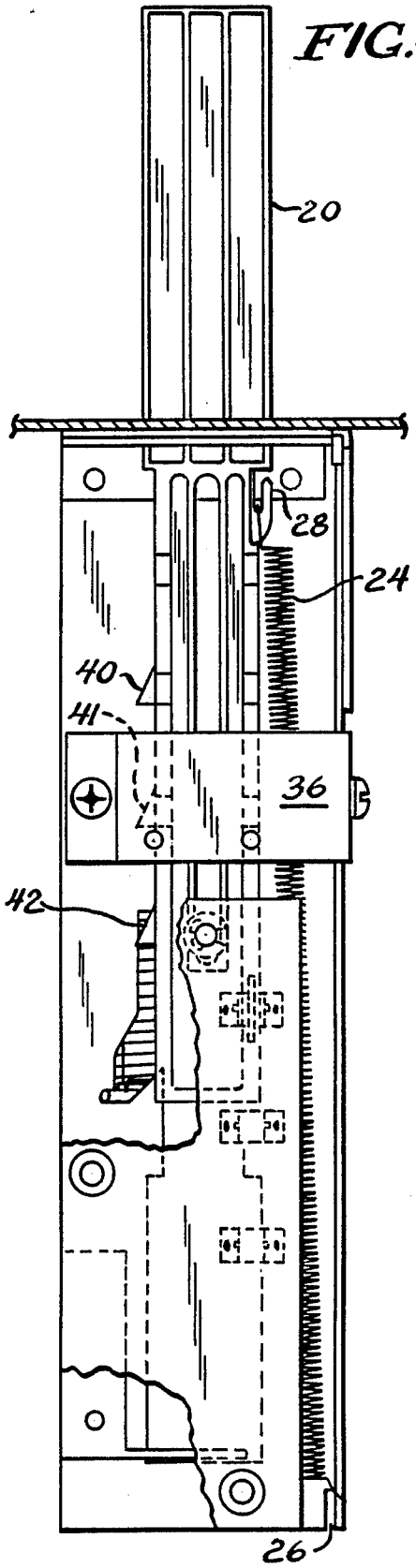
FIG. 4 is a rear elevation of the invention having portions cut away to reveal certain details.

The drop target is secured to the underside of the playfield 12 by means of a bracket 22 which also mounts the remaining portion of the mechanism. The bracket has an opening through its top to permit movement of the target member 20 there through. As shown in FIG. 4, the target member 20 is biased to its lowermost position by a spring 24, one end of which is secured to a notch 26, on the lower end of the bracket 22. The other end of the spring is secured to a finger projection 28 carried by the target member 20. Thus, in the absence of any interference, the target member is pulled to its retracted or lowermost position.

The target member carries two sets of vertically aligned projections. The positioning projections 30 through 32 co-act with a reciprocally formed ledge 34 carried on a plate 36 secured to the bracket 22. As will be apparent, the projections 30-32 secure the target member in selected positions extending partially or fully into the field of play. The target member is biased against the ledge 34 by a leaf-spring 38 positioned between the bracket 22 and the target member (FIG. 3). The leaf-spring ensures that the projections 30–32 reliably engage the ledge 34 during actuation of the drop target by a pinball.

The target member 20 carries a second set of projections, reset projections, 40, 41 and 42 on one side thereof, as best illustrated in FIG. 4. These projections, in cooperation with a reset mechanism to be described, permit a step-wise resetting of the drop target to a desired intermediate position or to the fully extended position. The reset mechanism includes a reset finger 44 which coacts with the reset projections 414 42 upon actuation of a solenoid mechanism 46. Mechanism 46 consists of a solenoid coil 48, a plunger 50, and electrical contacts 52 by which the operation of the solenoid is controlled. The solenoid is mounted to the bracket 22 by secondary brackets 54 and 55. The reset finger 44 is attached to the distal end of the plunger 50 by means of a cap nut 56 threadingly engaging the plunger. Concentrically mounted on the plunger 50 is a coil spring 58 (FIG. 3) one end of which presses against the lower bracket 55. The other end is secured to the reset finger 44 to bias the finger to a position against the side of the target member 20.

As is apparent in FIG. 4, the reset finger 44 extends through a cut-out portion of the bracket to permit its engagement with the reset projections 40–42 for purposes of resetting the drop target, as will be explained.

Preferably, there is mounted to the lower portion of the bracket 22, a circuit board 60 on a set of spacers 62 and appropriate fasteners. Carried by the circuit board 60 are a set of optical detectors 64, 65 and 66. These are solid state devices which provide an electrical output when an object passes between its horseshoe shaped arms thereby providing a signal which can be used by the control processor. These devices are well known in the art. The detectors 64–66 are arranged vertically on the circuit board 60 and directly in the path of an interrupter element 68 carried by the lower portion of the target member 20.

In the preferred embodiment, the interrupter will be positioned between the horseshoe arms of the detector 64 when the target member is in the uppermost position; between the arms of detector 65 in a first intermediate position; below the arms of detector 66 in a second intermediate position; and interact with none of the detectors in the fully retracted position. The electrical signal outputs from the detectors are provided to the control processor to accurately determine the position of the target member.

From the foregoing, the structure and operation of the invention will be apparent to those skilled in the art. To ensure a complete disclosure, however, the following description of the operation of the invention is provided.

Figure 5:
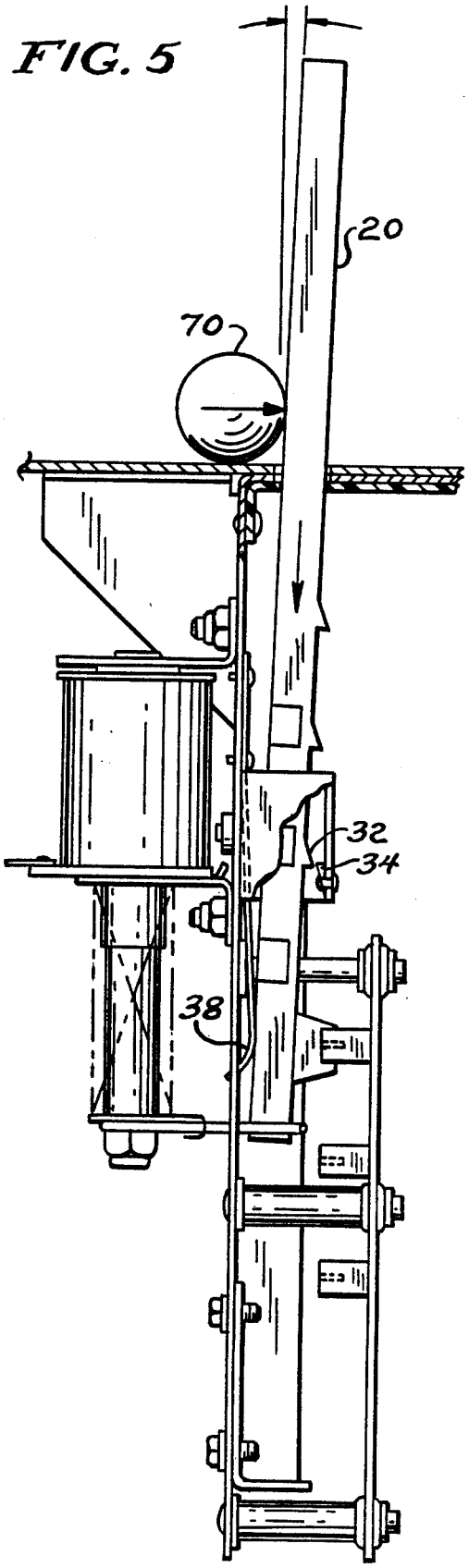
FIG. 5 is a view similar to FIG. 3 showing the manner in which a pinball actuates the invention.

Referring to FIG. 5, the invention is illustrated with the target member 20 in its uppermost position. When a pinball 70 strikes the target member, it causes an angular displacement from the vertical position sufficient to overcome the bias of leafspring 38. This frees the projection 32 from the ledge 34. In turn, the drop spring 24 pulls the target downwardly. The target member rapidly returns to the vertical position after being struck by the pinball so that the leaf-spring reasserts its bias to ensure that the projection 31 (the middle projection) engages the ledge 34. A similar operation occurs the next time the pinball strikes the target member. The result is that it requires multiple hits on the target member to fully retract it. Each hit can be worth a certain number of points or enable certain bonus features associated with the game.

Figure 6:
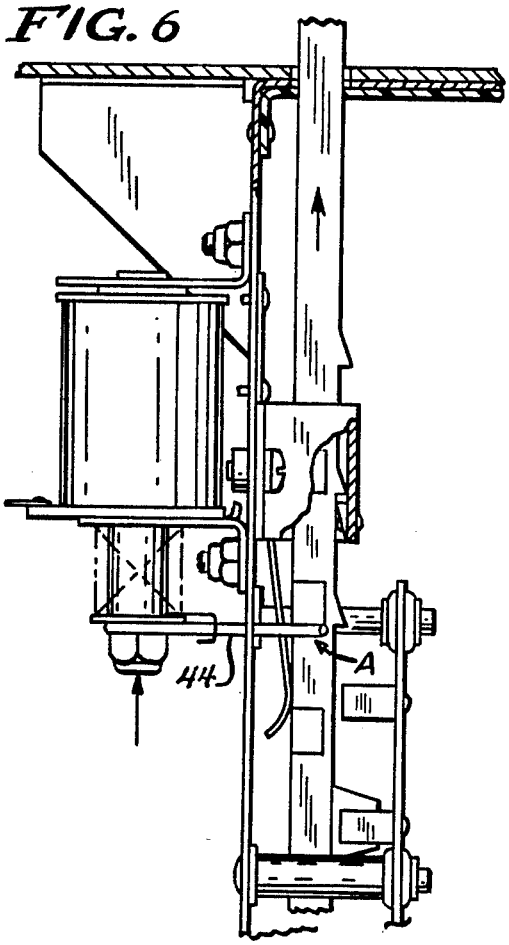
FIG. 6 is a partial side elevation showing the manner in which the drop target is reset.
Figure 7:
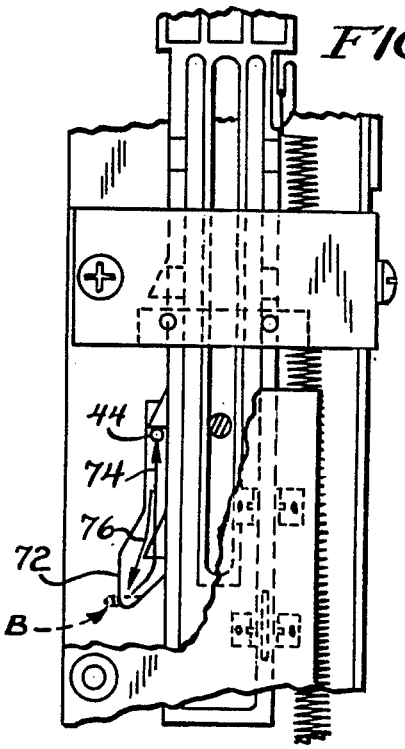
FIG. 7 is a view similar to FIG. 4 illustrating the motion of a portion of the reset mechanism.

When it is desired to reset the target member from its lowermost (or any intermediate position) the resetting mechanism 46 is actuated and operates as illustrated in FIGS. 4, 6 and 7. As previously indicated, the solenoid coil 48 is energized retracting the plunger 50 to the position shown in FIG. 6. This causes the finger 44 to engage one of the reset projections 40–42 located on the side of the target member, thereby to raise the target member by an amount equal to one stroke of the solenoid plunger. This causes the ledge 34 to disengage from the current projection (if any) and to engage the next lower one of the projections 30–32. Thus, one stroke of the solenoid mechanism serves to raise the drop target one position. In the illustrated embodiment, three strokes of the solenoid mechanism are required to move the target member from its lowermost position to its fully raised position. The manner in which the reset finger 44 engages the reset projections 40–42 is illustrated at A in FIG. 6.

FIG. 7 illustrates the effect of the concentrically mounted spring 58 (FIG. 3) on the reciprocating motion of the reset finger 44. In order to assure reliable operation of the reset mechanism, it is necessary that the finger be biased against the side of the target member during actuation of the solenoid. As shown in phantom at B in FIG. 7, the finger 44 is normally held out of contact with the target member when the solenoid is inactive. This is accomplished by a cut-out 72 provided in the bracket 22. When the solenoid is actuated, however, the finger member moves upwardly in the cut-out and follows the path illustrated by arrow 74, due to the effect of the spring 58, the end of which is wrapped around the finger 44 providing a torsional force thereon. This ensures that the finger will move into direct contact with the side of the target member to engage the reset projections. The return path, when the solenoid is de-energized is illustrated by arrow 76.

Accordingly there has been disclosed a multi-position drop target which is incrementally operated each time it is struck by a pinball from an uppermost position to a plurality of intermediate positions and a lowest position. A reset mechanism incrementally restores the target to its uppermost position or any desired intermediate position, one position at a time, as a function of the number of actuators of the resetting mechanism. The result is a versatile playfield feature which can be utilized for a wide variety of scoring applications.

While I have shown and described embodiments of the invention, it will be understood that this description and illustrations are offered merely by way of example, and that the invention is to be limited in scope only by the appended claims.

What is claimed is:

1. A multi-position drop target playfield feature for a rolling ball game comprising:
   (a) a target member extending above the playfield movable between a plurality of discrete vertical positions, and having a plurality of reset projections (40–42) vertically disposed thereon, each reset projection corresponding to a different vertical position of said target member;
   (b) means for lowering the target member one position each time it is struck by the rolling ball;
   (c) means for raising the target member to reset it to its initial position, or to any intermediate position, said means for raising including:
      (i) means for engaging said reset projections to raise the target member position;
      (ii) means for reciprocally driving said engaging means; whereby each operation of said driving means causes said engaging means to raise the target member one position.

2. The apparatus of claim 1 in which said playfield feature includes means for detecting the position of said target member.

3. The apparatus of claim 1 in which said target member has a plurality of positioning projections (30–32) disposed thereon at vertical intervals, said means for lowering the target member including:
   (a) a ledge (34) positioned beneath the playfield and adapted to engage said positioning projections, each positioning projection defining a different one of said vertical positions;

said rolling ball striking said target member causing momentary disengagement of the ledge from one of said positioning projections permitting the target member to drop to the next vertical position.

4. The apparatus of claim 3 in which said means for lowering the target member further includes:

(a) a first spring for biasing the target member toward the lowest position;

(b) a second spring for biasing the target member against the ledge to ensure engagement of the ledge with the first projections.

5. The apparatus of claim 1 in which said engaging means is a finger element disposed adjacent said target member, said driving means reciprocating said finger element in a substantially vertical direction.

6. The apparatus of claim 1 in which said driving means is a solenoid mechanism which drives said engaging means in a substantially vertical direction.

7. The apparatus of claim 1 in which said engaging means is a finger element disposed adjacent said target member, said driving means is a solenoid mechanism which reciprocates said finger element in a substantially vertical direction.

* * * * *

UNITED STATES PATENT AND TRADEMARK OFFICE

CERTIFICATE OF CORRECTION

PATENT NO. : 4,943,061

DATED : Jul. 24, 1990

INVENTOR(S) : Irwin J. Grabel

It is certified that error appears in the above—identified patent and that said Letters Patent is hereby corrected as shown below:

Column 4, Line 49 should read, "raise the target member to a position above its present position;"

Signed and Sealed this

Twenty-seventh Day of August, 1991

*Attest:*

*Attesting Officer*

HARRY F. MANBECK, JR.

*Commissioner of Patents and Trademarks*